US007530550B2

(12) United States Patent
Fattori

(10) Patent No.: US 7,530,550 B2
(45) Date of Patent: May 12, 2009

(54) APPARATUS AND METHOD FOR POST MOUNT GUIDE

(75) Inventor: James G. Fattori, Trevose, PA (US)

(73) Assignee: LMT-Mercer Group Inc., Lawrenceville, NJ (US)

( * ) Notice: Subject to any disclaimer, the term of this patent is extended or adjusted under 35 U.S.C. 154(b) by 29 days.

(21) Appl. No.: 11/799,772

(22) Filed: May 3, 2007

(65) Prior Publication Data

US 2008/0272353 A1 Nov. 6, 2008

(51) Int. Cl.
*E04H 17/00* (2006.01)

(52) U.S. Cl. ..... 256/65.05; 256/65.14

(58) Field of Classification Search ..... 256/19, 256/59, 66, 68, 69, 65.03, 65.04, 65.14; 52/737.4, 52/738.1, 736.3; 248/218.4, 219.1
See application file for complete search history.

(56) References Cited

U.S. PATENT DOCUMENTS

| | | | | |
|---|---|---|---|---|
| 726,801 | A * | 4/1903 | Maxwell | 138/115 |
| 3,113,760 | A | 12/1963 | Huret et al. | |
| 3,241,279 | A | 3/1966 | Bailey | |
| 3,256,659 | A | 6/1966 | Dudoff | |
| 3,349,531 | A | 10/1967 | Watson | |
| 3,698,564 | A | 10/1972 | Müller | 211/86 |
| 4,104,000 | A | 8/1978 | Fleischmann | 403/7 |
| 4,809,955 | A | 3/1989 | Veilleux | 256/65 |
| 4,958,807 | A * | 9/1990 | Wylie | 256/65.03 |
| 5,203,817 | A | 4/1993 | Klumpjan | 52/298 |
| 5,444,951 | A | 8/1995 | Scott et al. | 52/169.9 |
| 6,098,353 | A | 8/2000 | Stanfield | 52/170 |
| 6,141,928 | A * | 11/2000 | Platt | 52/296 |
| 6,213,452 | B1 | 4/2001 | Pettit et al. | 256/59 |
| 6,467,756 | B1 * | 10/2002 | Elsasser | 256/65.14 |
| 6,508,457 | B1 | 1/2003 | Knudson et al. | 256/65.01 |
| 6,643,982 | B1 * | 11/2003 | Lapp et al. | 52/127.2 |
| 6,718,710 | B2 | 4/2004 | Platt | 52/296 |
| 6,739,103 | B1 * | 5/2004 | Noirot | 52/309.1 |

(Continued)

OTHER PUBLICATIONS

American Way Manufacturing, Inc.; Vinyl Rail Bracket Systems & Trim; 1871 Henn Parkway, Lordstown, OH 44481; www.americanwaymfg.com; Aug. 2005; 6 pages.

(Continued)

*Primary Examiner*—Daniel P Stodola
*Assistant Examiner*—Joshua T Kennedy
(74) *Attorney, Agent, or Firm*—Kenneth Watov; Watov & Kipnes, P.C.

(57) ABSTRACT

A post mount guide includes a tubular body having a through-hole for non-frictionally freely slidably receiving therethrough an upright support portion of a post mount, at least one pair of mounting panels having each panel positioned 90° from the other and adjacent to one another, the panels extending spaced apart from and connected at one end to the tubular body, wherein the mounting panels of each pair of panels are adapted to resiliently bend and configured to receive and retain a fastener therethrough, and a stop mechanism is included with each pair of panels for stopping the panels from bending beyond a fixed position toward the tubular body. The stop mechanism includes first and second end portions of the adjacent mounting panels, respectively, being configured for reversible abutting engagement with one another upon bending inward to the fixed position toward the tubular body.

15 Claims, 9 Drawing Sheets

U.S. PATENT DOCUMENTS

| | | | | |
|---|---|---|---|---|
| 6,886,296 | B1 | 5/2005 | John et al. | 52/170 |
| 7,306,203 | B2 * | 12/2007 | Platt | 256/65.14 |
| 2002/0121635 | A1 | 9/2002 | Erwin | 256/65.01 |
| 2003/0101679 | A1 | 6/2003 | Erwin | 52/736.3 |
| 2003/0221385 | A1 | 12/2003 | Platt | 52/296 |
| 2003/0233793 | A1 | 12/2003 | Burkart et al. | 52/165 |
| 2004/0026679 | A1 * | 2/2004 | Terrels et al. | 256/65.03 |
| 2005/0252124 | A1 | 11/2005 | Bergman | 52/296 |
| 2006/0065885 | A1 * | 3/2006 | Stanley | 256/59 |
| 2006/0081829 | A1 | 4/2006 | Platt | 256/65.01 |
| 2006/0091372 | A1 | 5/2006 | Rosian | 256/65.01 |
| 2006/0169966 | A1 | 8/2006 | Platt | 256/65.01 |
| 2006/0254195 | A1 * | 11/2006 | Platt | 52/736.1 |
| 2007/0215767 | A1 * | 9/2007 | Leary | 248/214 |
| 2007/0241317 | A1 * | 10/2007 | Kuenzel | 256/65.14 |

OTHER PUBLICATIONS

A Tested Post and Block Mounting System, Approved by Industry Professionals that Works "To Your Advantage" with Any Bracketed Railing System!; Advantage Post Mount Systems; Performance Test Report, rendered to; Vinylast Inc., Product: TKG Post Mount; Architectural Testing; Report No. 61148.01-119-19; Report Date Nov. 30, 2005; 15 pages.

EZ Post Mounting System In A Box; EZ Mount, Inc. 801 Rohrerstown Road, Lancaster, PA; http://www.postmount.com/what.html; Aug. 30, 2006; 3 pages.

Post Towers; Hoover Fence Co.; http://www.hooverfence.com/vinyl/hardware/post-tower.htm; Aug. 30, 2006; 2 pages.

Fairway Vinyl Systems; http://www.fairwayvinyl.com/accessories.htm; Aug. 30, 2006; 3 pages.

UltiMount Post Mount System; 2 pages.

* cited by examiner

APPARATUS AND METHOD FOR POST MOUNT GUIDE

FIELD OF THE INVENTION

The present invention relates to fencing systems, and more particularly to a fencing system utilizing post mount guides for securely and effectively mounting a post of a fence or railing section to a substrate such as a wooden deck or concrete pad.

BACKGROUND OF THE INVENTION

Fences have been used for many years as freestanding structures for providing privacy, marking territorial boundaries and/or to restrict or prevent movement onto or off of property areas. Fences have also been used for enhancing the appearance of a property. A common form of fencing utilizes a system of vertical posts connected by horizontal rails to which pickets, slats, panels or chain links are attached. Generally, these components are attached to one another with fasteners such as nails, screws, or nuts and bolts.

The vertical fence posts and the horizontal railings used in constructing fences have typically been made of wood. However, the traditional wood construction has become less desirable for several reasons. A primary drawback is that the overall cost of maintaining a wooden fence system is relatively high due to the escalation in the cost of lumber materials in recent years and the fact that wood fences require constant maintenance such as painting or staining, and further require maintenance to prevent rot. This is particularly true when wooden posts supporting a fence are anchored in the ground. If the posts fail due to rot, the entire fence is rendered useless. Although anchoring the posts in concrete can postpone these effects, it does not eliminate them.

As an alternative to the wood fencing systems, it has recently become more prevalent to use either vinyl or plastic products for constructing fences for yards or decks, and for railings on deck staircases. Vinyl fencing is aesthetically pleasing and easy to maintain. However, they are susceptible to structural weakness and fatigue over time. For this reason, reinforcement means are typically used to add structural integrity and stability to the fence.

The reinforcement means can be in the form of an appropriately shaped metal insert extending throughout the interior length of the fence rail, and/or a post such as a tubular metal post, which resides within the hollow vinyl fence post. A post can be securely anchored to the base substrate or ground. The fence components including the railings are typically assembled and attached to the reinforced vinyl fence post.

Although this reinforced construction provides good strength to the fence, the fence post remains a weak point in the structure. In addition to the stress of the normal fence load, the vinyl fence post experiences strain induced by thermal expansion and contraction during temperature changes and conditions that can cause undesirable warping and bending. This warping and bending can be detrimental to the structural integrity and appearance of the overall fence.

Accordingly, there is a need for a fence assembly that utilizes a post mount guide for securely and effectively mounting a fence to a post mount to provide greater durability, strength and stability, while greatly minimizing or eliminating the occurrence of undesirable warping or bending. There is a further need for a post mount guide that is simple to install, and readily adjustable for accommodating a range of fence styles and configurations. There is a further need for a post mount guide for substantially reducing the cost and labor typically associated with fence installation and subsequent maintenance, and that can readily be implemented with standard tools and fasteners.

SUMMARY OF THE INVENTION

The present invention relates generally to a post mount guide for installation on an upright support portion of a post mount to securely and effectively mount a fence to the post mount, and a method for using the same. The post mount guide of the present invention is designed to simplify the fabrication of fence assemblies, while enhancing the durability, strength, and stability of the resulting fence. Furthermore, the post mount guide of the present invention substantially reduces or eliminates undesirable warping or bending of the fence assembly, and has no frictional sliding or interference fit with the interior wall of a decorative cover installed over the post mount. In particular, the post mount guide of the present invention operates to securely attach fence structures to an upright support portion of a post mount secured to a base substrate or ground. The post mount guide of the present invention is compatible for use in a range of fencing styles and configurations. The post mount guide of the present invention substantially reduces the cost and labor typically associated with fence installation and subsequent maintenance, and can readily be implemented with standard tools and fasteners.

Generally, the post mount guide of the present invention includes a truncated tubular portion, regardless of shape or cross section, adapted for sliding engagement onto the upright support portion of the post mount, and is affixed in position on the post mount through the use of suitable fastener (s). The post mount guide further includes at least one pair of panels with opposing end portions being adjacent to one another, each panel extending spaced apart from and connected at one end to a centrally located tubular body, wherein the mounting panels are adapted to resiliently bend, and are each configured to receive and retain a fastener therethrough. The panels of the post mount guide provide surface areas for attachment of fencing components including railing brackets and associated railings to the post mount.

In a preferred embodiment of the present invention, the post mount guide is adapted to receive and retain a hollow post or decorative cover for mounting over the length of the post mount prior to the attachment of the fencing components. In this embodiment, the fencing fasteners are secured through the decorative cover or hollow decorative post to the post mount guide, or to a plurality of post mount guides. Four pairs of panels equally spaced apart on each post mount guide with each pair of panels having their panels oriented 90° from one another.

In a more preferred embodiment of the present invention, the post mount guide include four pairs of L-shaped mounting panels, each one having an end of a relatively short segment of the mounting panel connected to the tubular body, and a free end of a relatively longer segment of the mounting panel opposing the free end of the other panel. The opposing ends being configured for abutting against one another to limit inward bending of the panels toward the tubular body, while permitting outward bending of each panel.

In one aspect of the present invention, there is provided a post mount guide, comprising:

a tubular body having a throughhole for slidably receiving therethrough an upright support portion of a post mount;

at least one pair of mounting panels each extending spaced apart from and having one ended connected to the tubular body, said mounting panels having free ends adapted to resilently bend outward away from one another, and configured to receive and retain a fastener therethrough; and means for stopping the panels from bending inward beyond a fixed position toward the tubular body, while permitting the panels to bend outward away from the tubular body.

In a further aspect of the present invention, there is provided a fence assembly, comprising:

at least one post mount including an upright support portion configured for anchoring to a base;

at least one post mount guide, comprising:

(a) a tubular body having a throughhole for slidably mounting upon and receiving therethrough the upright support portion of the post mount;

(b) at least one pair of mounting panels extending spaced apart from and having one end connected to the tubular body, said mounting panels having free ends adapted to resilently bend outwardly from one another, and are configured to receive and retain a fastener therethrough;

(c) means for stopping the panels from bending inward beyond a fixed position toward the tubular body, while permitting the panels to bend outward away from said tubular body;

a decorative hollow post cover configured to slidably house the upright support portion of the post mount and said at least one post mount guide therein; and at least one horizontally oriented rail bracket fastened through the decorative hollow post onto the corresponding panels of the respective post mount guide via fasteners.

In an even further aspect of the present invention, there is provided a method for securely and effectively mounting fence components to a post mount, comprising the steps of:

securing a post mount having an upright support portion firmly to a base substrate, the post mount having one end rigidly attached thereto;

obtaining the post mount guide through the steps of:

(a) forming a tubular body having a throughhole for slidably receiving therethrough the upright support portion of the post mount, (b) forming at least one pair of mounting panels each extending spaced apart from and having one end connected to the tubular body, said mounting panels having free ends adapted to resiliently bend outwardly away from one another, configured to receive and retain a fastener therethrough, and (c) forming means for stopping the panels from bending inward beyond a fixed position toward the tubular body;

positioning the post mount guide at a desired position along the length of the upright support portion of the post mount; and fastening a fence railing bracket to one of the panels of the post mount guide.

BRIEF DESCRIPTION OF THE DRAWINGS

The following drawings, in which like items may have the same reference designations, are illustrative of embodiments of the present invention and are not intended to limit the invention as encompassed by the claims forming part of the application, wherein:

DETAILED DESCRIPTION OF THE INVENTION

The present invention is directed generally to a post mount guide for installation on an upright support portion of a post mount to securely and effectively mount a fence to the post mount, and a method for using the same. The post mount guide of the present invention is designed to simplify the fabrication of fence assemblies, while enhancing the durability, strength, and stability of the resulting fence. Furthermore, the post mount guide of the present invention substantially reduces or eliminates undesirable warping or bending of the fence assembly. In particular, the post mount guide of the present invention operates to securely attach fence structures to an upright support portion of a post mount secured to a base substrate or ground. The post mount guide of the present invention is compatible for use in a range of fencing styles and configurations. The post mount guide of the present invention substantially reduces the cost and labor typically associated with fence installation and subsequent maintenance, and can readily be implemented with standard tools and fasteners.

Broadly, the post mount guide of the present invention includes a truncated tubular portion adapted for sliding engagement onto the upright support portion of the post mount, and is affixed in position on the post mount through the use of suitable fasteners. The post mount guide further includes at least one pair of panels with opposing end portions being adjacent to one another, each panel extending spaced apart from and connected at one end to a centrally located tubular body, wherein the mounting panels are adapted to resiliently bend, and are each configured to receive and retain a fastener therethrough. The panels of the post mount guide provide surface areas for attachment of fencing components including railing brackets and associated railings to the post mount.

In a preferred embodiment of the present invention, the post mount guide is adapted to receive and retain a hollow post or decorative cover, for mounting over the length of the post mount and post mount guides, prior to the attachment of the fencing components. In this embodiment, the fencing fasteners are secured through the decorative cover or hollow decorative post to the post mount guide, or to a plurality of post mount guides. Four pairs of panels equally spaced apart on each post mount guide with each pair of panels having their panels oriented 90° from one another.

In a more preferred embodiment of the present invention, the post mount guide include four pairs of L-shaped mounting panels, each one having an end of a relatively short segment of the mounting panel connected to the tubular body, and a free end of a relatively longer segment of the mounting panel opposing the free end of the other panel. The opposing ends being configured for abutting against one another to limit inward bending of the panels toward the tubular body, while permitting outward bending of each panel.

Figure 1A:
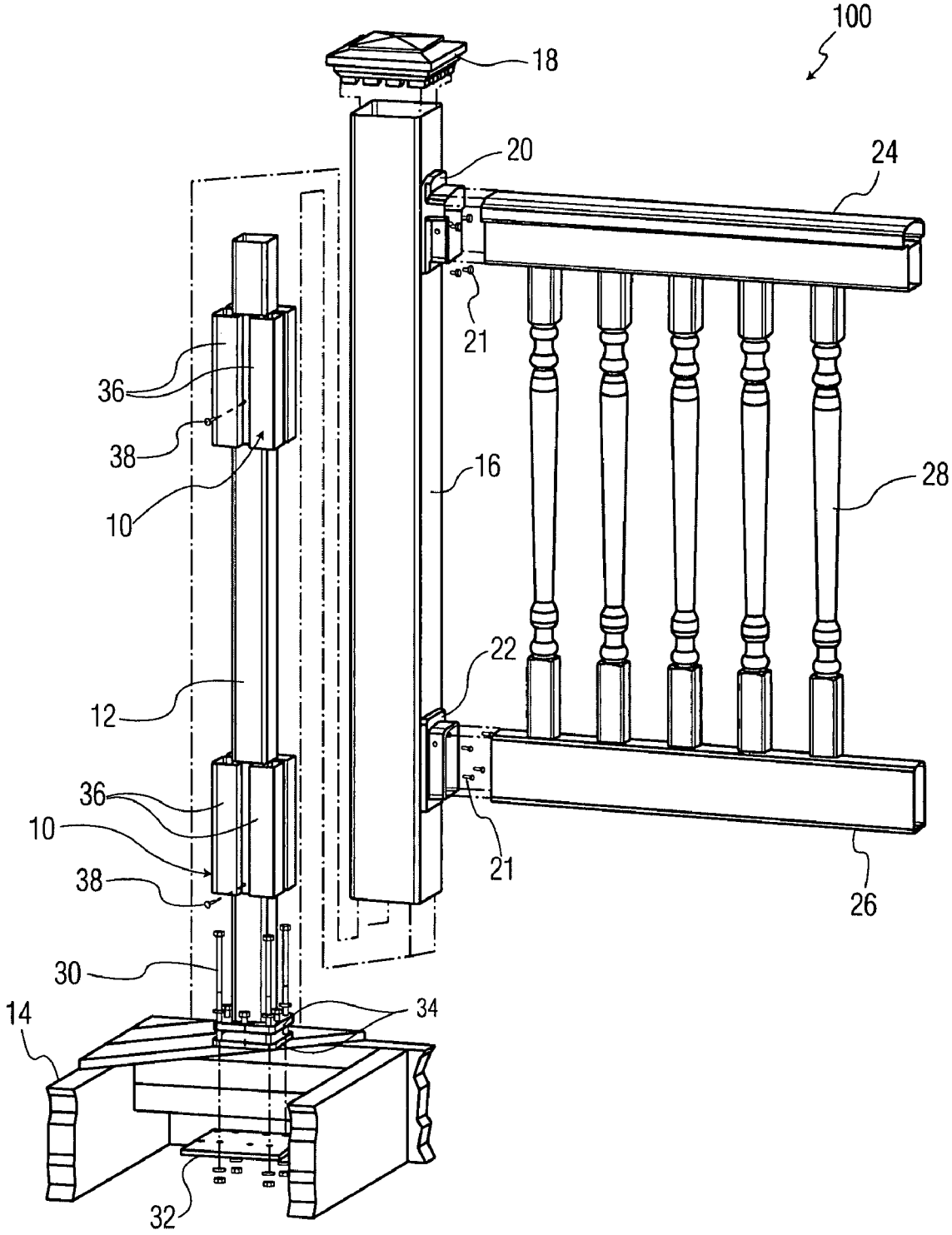
FIG. 1A is an exploded assembly view of a fence assembly utilizing a pair of post mount guides for one embodiment of the present invention.
Figure 1B:
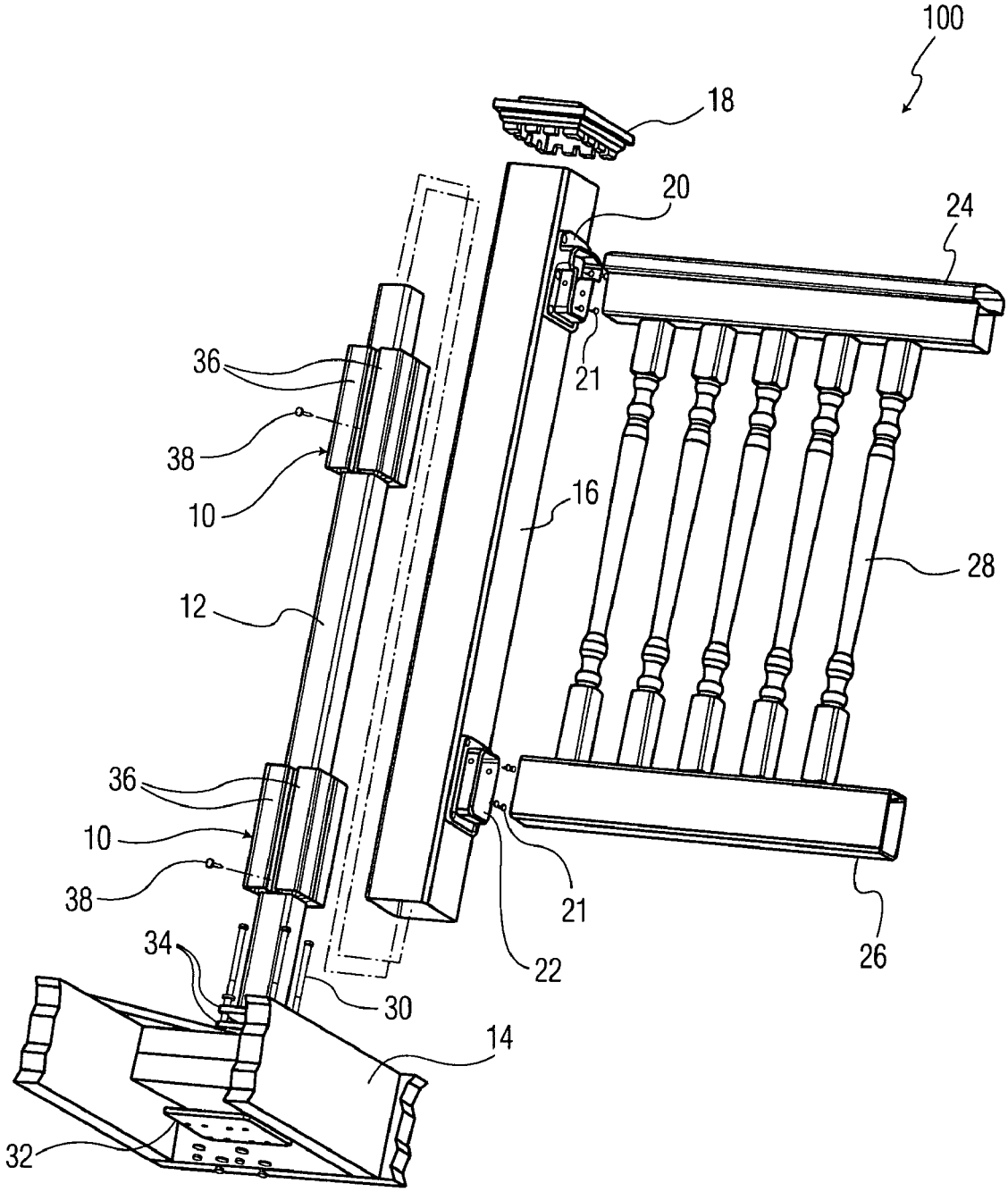
FIG. 1B is an exploded assembly view of the fence assembly of FIG. 1A viewed toward the bottom thereof in accordance with the present invention.

Referring to FIGS. 1A and 1B, there is shown a pair of post mount guides identified generally by reference numeral 10 forming part of a railing assembly 100 for one embodiment of the present invention. In this embodiment, the post mount guides 10 are each configured for mounting on an upright vertical support or post mount 12 in a spaced apart manner, and secured into position by a suitable fastener such as a screw, an adhesive or the like. Preferably, the post mount guides 10 are secured to the post mount 12 through the use of screw fasteners 38. The post mount guides 10 provide attachment points for the fence components to the post mount 12 as will be further described hereinafter. The positions, numbers and configurations of the post mount guides 10 mounted along the length of the post mount 12 can be readily adjusted or modified depending on the fence arrangement, style, design, and desired height of the fence components.

Figure 2:
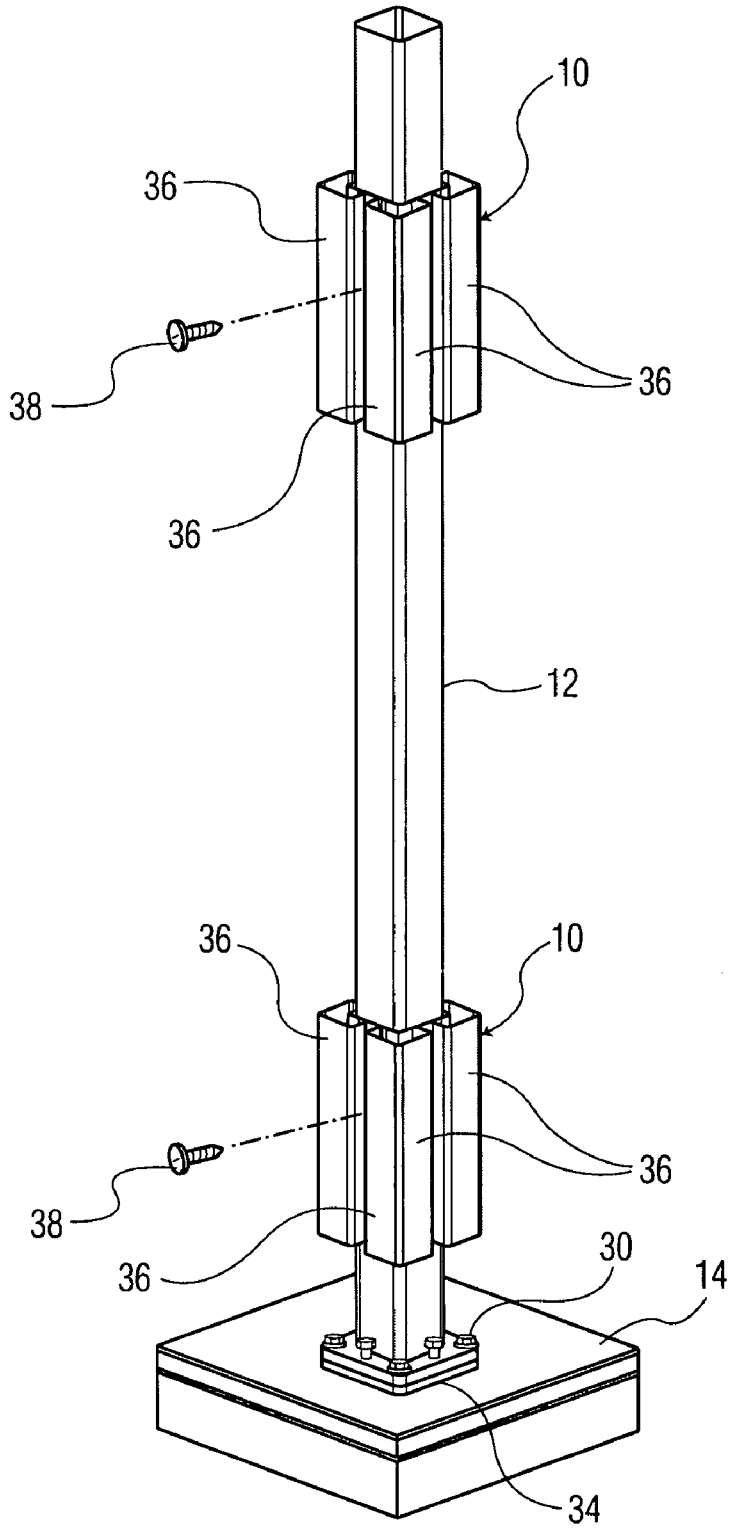
FIG. 2 is an pictorial view of a pair of post mount guides mounted upon an upright support portion of a post mount for one embodiment of the present invention.

The post mount 12 is adapted to bear the weight and forces typically encounter by a fence structure, and is rigidly anchored to a base support substrate 14 such as, for example, a deck, a porch or the ground. In this embodiment, the post mount 12 is secured to the substrate 14 in the form of a deck through the use of nut-bolt fasteners 30 connected to a back plate 32 located on the opposite side of the substrate 14. A leveling plate 34 is furnished between the base of the post mount 12 and the substrate 14 to provide proper height adjustments as needed. The post mount guides 10 and post mount 12 are configured to receive and retain a hollow post or decorative cover 16 therearound. To ensure proper fit, the post mount guides 10 should both be secured at a desired height before receiving the decorative cover 16 as shown in FIG. 2, for example. A top cap 18 is furnished to enclose the top end of the cover 16.

The fence assembly 100 further includes top and bottom railing brackets 20 and 22 configured for attachment to the corresponding post mount guides 10, top and bottom railings 24 and 26 configured for attachment to the corresponding railing brackets 20 and 22, respectively, and a plurality of vertical fence elements or balusters 28 configured for mounting therebetween, this example. Fence components such as the decorative covers 16, top caps 18, top and bottom railings 24 and 26, respectively, spindles, slats or balusters 28, and railing brackets 20 and 22, respectively, can be fabricated from a range of materials including, but not limited to plastic polymers such as extruded or molded thermoplastic polymer, metal such as steel or aluminum, wood, and the like, as known in the art of fence building. Additionally, the style and exterior appearance of the fence assembly 100 is not limited to the present embodiment shown, and can readily be modified in accordance with the present invention by those skilled in the art.

Figure 3:
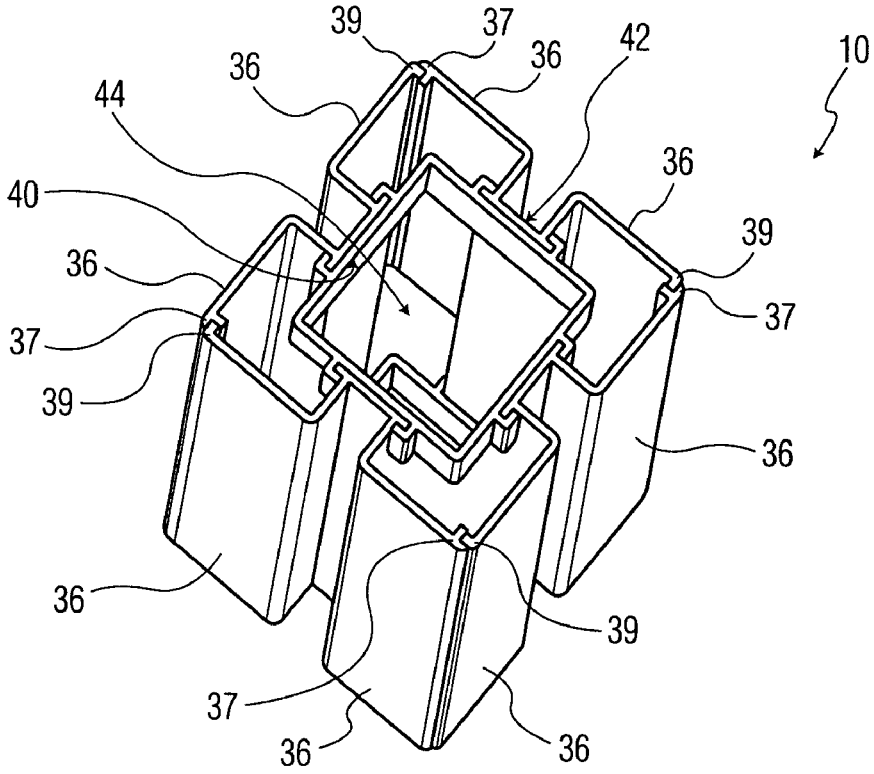
FIG. 3 is a perspective view of a post mount guide for one embodiment of the present invention.
Figure 4:
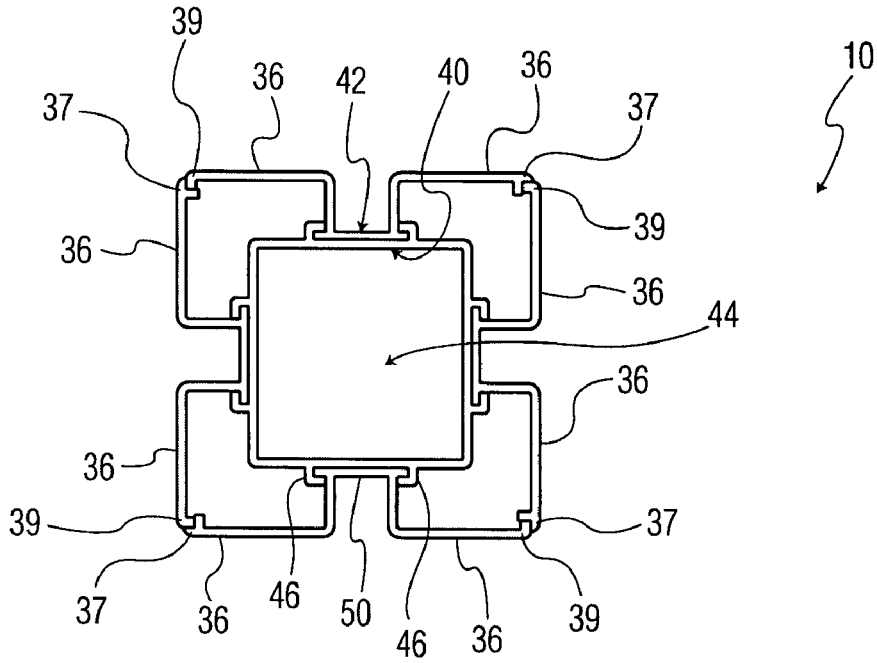
FIG. 4 is a top plan view of the post mount guide of FIG. 3 in accordance with the present invention.

As shown in FIGS. 3 and 4, the post mount guides 10 each include four pairs of mounting panels 36, which together form a rectangular shape or profile substantially matching the interior sides or cross section of the decorative cover 16, for permitting the latter to freely and loosely slide over the guides 10. Each pair of the mounting panels 36 include free end portions 37, which are adapted to resiliently bend when force is applied thereto, and are operatively engaged to one another for limiting the range of movement as will be further described in detail hereinafter. The mounting panels 36 each provide a surface area for attachment of fence components thereto through the decorative cover 16.

Once the post mount guides 10 are properly secured to the post mount 12, the decorative cover 16 is slipped over the length of the post mount 12 down to the base support substrate 14. A bottom cap (not shown) can be placed between the lower end of the decorative cover 16 and the base support substrate 14 to enhance the aesthetic appearance. Preferably, the post mount guides 10 are dimensioned to fit snugly within the space between the post mount 12 and the interior wall of the decorative cover 16. The post mount guides 10 are configured to accommodate a range of spacing tolerances in the decorative cover 16. The mounting panels 36 of the post mount guide 10 are each positioned substantially parallel with the corresponding interior wall of the decorative cover 16. Preferably, the mounting panels 36 are configured to bias slightly outward to contact the corresponding interior wall of the decorative cover 16.

With further reference to FIGS. 1A and 1B, the top and bottom railing brackets 20 and 22 are mounted onto the decorative cover 16 and fastened to the corresponding underlying post mount guides 10 using screw fasteners 21, preferably in the form of self-tapping screws. The screw fasteners 21 extend through the mounting holes of the brackets 20 and 22 through the decorative cover 16, and into the mounting panels 36 of the post mount guides 10 for secure attachment to the post mount 12. The top and bottom railings 24 and 26 are mounted to the corresponding top and bottom railing brackets 20 and 22 with the balusters 28 retained therebetween, using an adhesive, fastener, or other suitable means.

The mounting panels 36 of the post mount guides 10 are configured to facilitate the penetration of the screw fasteners 21, while maintaining contact with the interior walls of the cover 16 to create a unitary, integral structure. More specifically, the mounting panels 36 are adapted to bend outwardly, while restricting inward bending as will be further described hereinafter. The mounting panels 36 enable a tight securement of the screw fasteners 21 into the post mount guide 10 to be achieved without the need to pre-drill, and permit the post mount guide 10 to readily accommodate variations in the interior dimensions of the cover 16. As a result, this produces a reinforced structure capable of resisting bending or warping or cracking of the decorative cover 16 that may occur in the resulting fence due to temperature changes and normal loading forces.

Referring to FIG. 2, the post mount guides 10 are adapted to fit over and freely and loosely slide along the length of the post mount 12. The guides 10 are secured into position on the post mount 12 through the use of the screw fasteners 38. The post mount guides 10 provide attachment points or surfaces for the fence components to the post mount 12 as will be further described hereinafter. The positions of the post mount guides 10 along the length of the post mount 12 can be readily adjusted depending on the fence configuration, design, and desired height of the fence components.

The post mount 12 can be constructed to be solid or hollow, and can include any cross sectional shape including round, rectangular, slotted or polygonal, for example. The preferred cross sectional shape is rectangular. The post mount 12 is generally constructed from rigid material, preferably a high-tensile strength material including a metal such as steel, aluminum and the like, capable of withstanding shear and load forces typically encountered in fence assemblies. Preferably, the post mount 12 is treated for corrosion resistance such as, for example, by applying a zinc coating or a protective coating, such as Dacromet® basecoats manufactured by Metal Coatings International of Chardon, Ohio.

Referring to FIGS. 3 and 4, the post mount guide 10 comprises a rectangular central truncated tubular portion 40 and four panel member portions 42 attached to and extending from each side thereof, as shown. Each panel member portion 42 includes a pair of mounting panels 36 with free end portions 37 engaged to the free end portions 39 of the mounting panels 36 of adjacent panel member portions 42. The panel member portions 42 are each attached to the central tubular portion 40 through a tongue and groove engagement as will be described hereinafter. The central tubular portion 40 includes a centrally located throughhole 44 extending through the length thereof. The throughhole 44 is suitably dimensioned for slidably receiving the post mount 12.

The free end portions 37 of each of the mounting panels 36 are each operatively engaged to or interactive with the free end portions 39 of adjacent mounting panels 36, respectively. As previously described, the mounting panels 36 are capable of resiliently bending in response to a radially directed force applied thereto. The abutting engagement between the free end portions 37 and 39 of the adjacent mounting panels 36 is configured to restrict the inward bending movement of the mounting panels 36, while permitting respective outward bending movement of the mounting panels 36 as will be further described hereinafter. The size and shape of the post mount guide 10 and the throughhole 44 is not limited to those shown and described herein, and can vary and be modified according to the corresponding configuration and style of the post mount 12 and the decorative cover 16.

The post mount guides 10 are generally constructed from rigid material, preferably a high strength material including metals such as steel, aluminum and the like. Aluminum, capable of withstanding shear and load forces typically encountered by fence assemblies, is the preferred material. More preferably, the post mount guides 10 are further treated for corrosion resistance such as, for example, by applying a zinc coating or a protective coating, such as Dacromet® basecoats.

Figure 5:
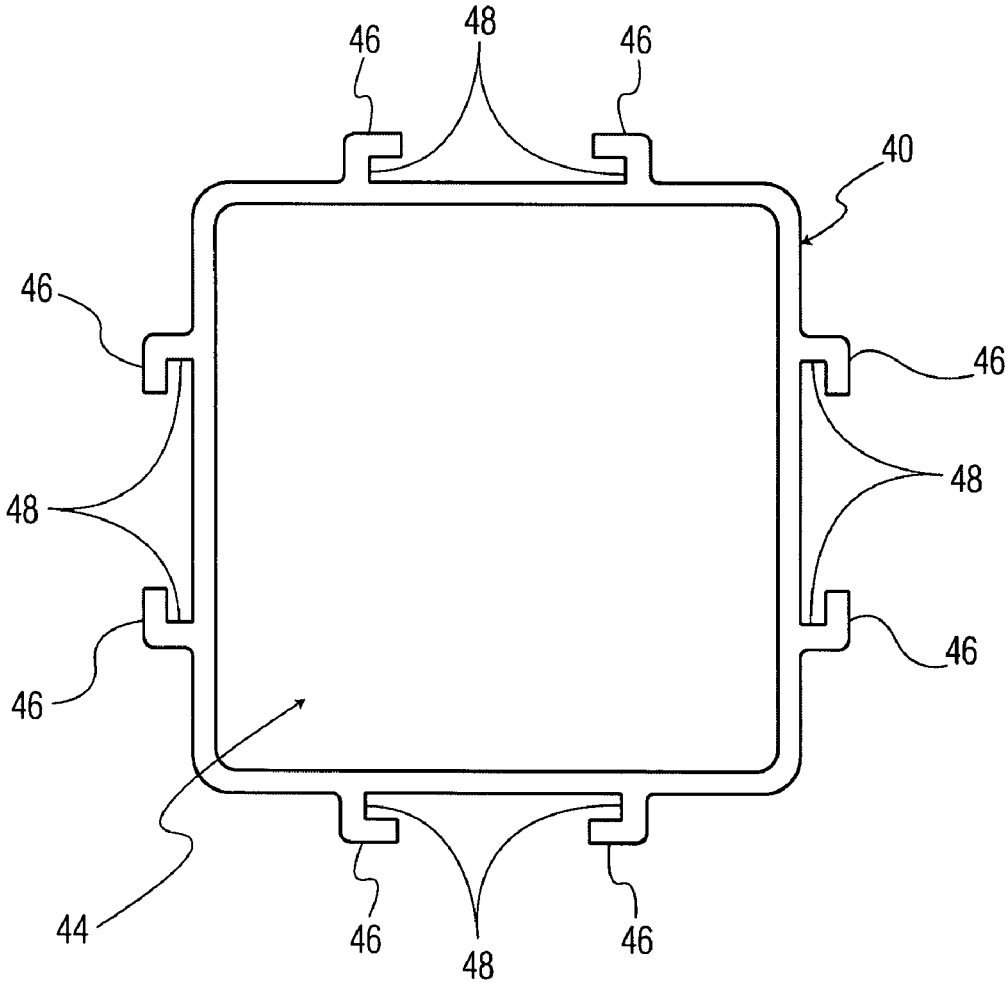
FIG. 5 is a top plan view of a center portion of the post mount guide of FIG. 3 in accordance with the present invention.
Figure 6:
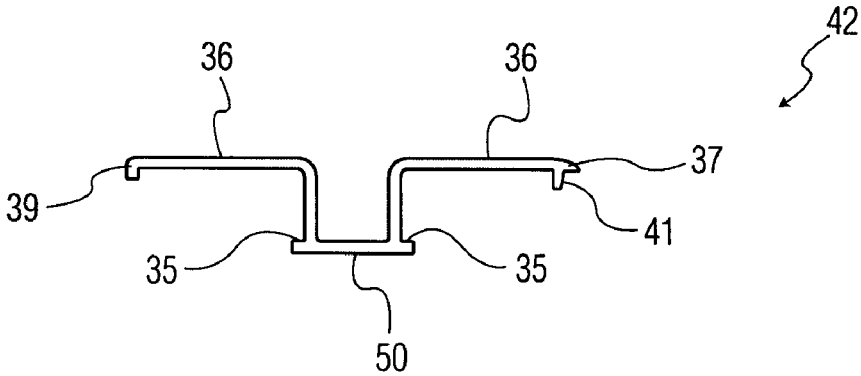
FIG. 6 is a top plan view of a panel member portion of the post mount guide of FIG. 3 in accordance with the present invention.

Referring to FIGS. 5 and 6, the central tubular portion 40 includes a pair of spaced apart square C-shaped protrusions 46 extending longitudinally along each side thereof. The pair of protrusions 46 each defines a narrow groove 48 with an open area therebetween. As shown in FIG. 6, each panel member portion 42 includes the mounting panels 36 attached to and extending from a base portion 50 extending along the posterior side of the mounting panels 36. The base portion 50 of each of the panel member portions 42 includes extending side portions 35 configured to snugly slide into the corresponding grooves 48 of the central tubular portion 40 (as shown in FIG. 5), and be retained therein (see FIG. 4) by welding, crimping, or suitable means to form the post mount guide 10. The central tubular portion 40 and the panel member portion 42 are preferably composed of a metal or alloy thereof, and more preferably aluminum, whereas wood is least preferred.

Figure 7:
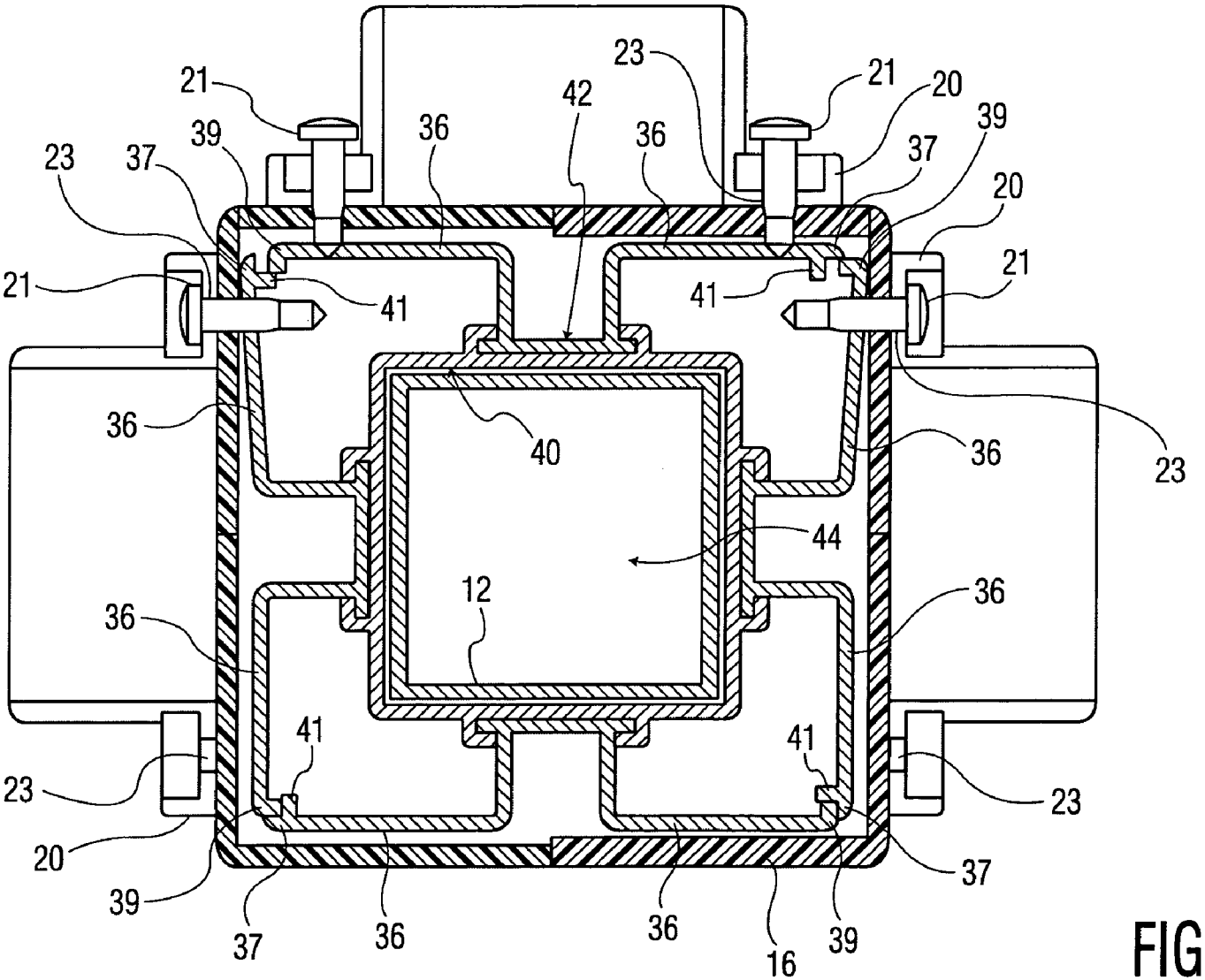
FIG. 7 is a top cross-sectional view of the post mount guide of FIG. 3 installed in the fence assembly in accordance with the present invention.

Referring to FIG. 7, the post mount guide 10 is installed on the post mount 12 within the decorative cover 16. One or more top railing brackets 20 with corresponding fastener holes 23 are each positioned exterior to the cover 16 for mounting to the mounting panels 36 of the post mount guide 10. The fastener holes 23 permit the screw fasteners 21 to be inserted therethrough. The free end portions 37 of the mounting panels 36 further include projections 41 adapted to coact with the bent over end portions 39 of adjacent panels 36 to provide stop mechanisms for blocking the inward bending motion of free end portion 37 and 39, respectively, while permitting outward bending movement thereof away from the center portion 40. This allows the mounting panel 36 to resist the force from an inwardly bound screw fastener 21 for permitting better penetration through the panel 36 during the tightening process. Once the screw fastener 21 penetrates the corresponding mounting panel 36 and is further tightened, the screw fastener 21 can draw the mounting panel 36 outwardly to firmly contact and brace against the interior wall of the cover 16 resulting in a tight, secure engagement.

Figure 8:
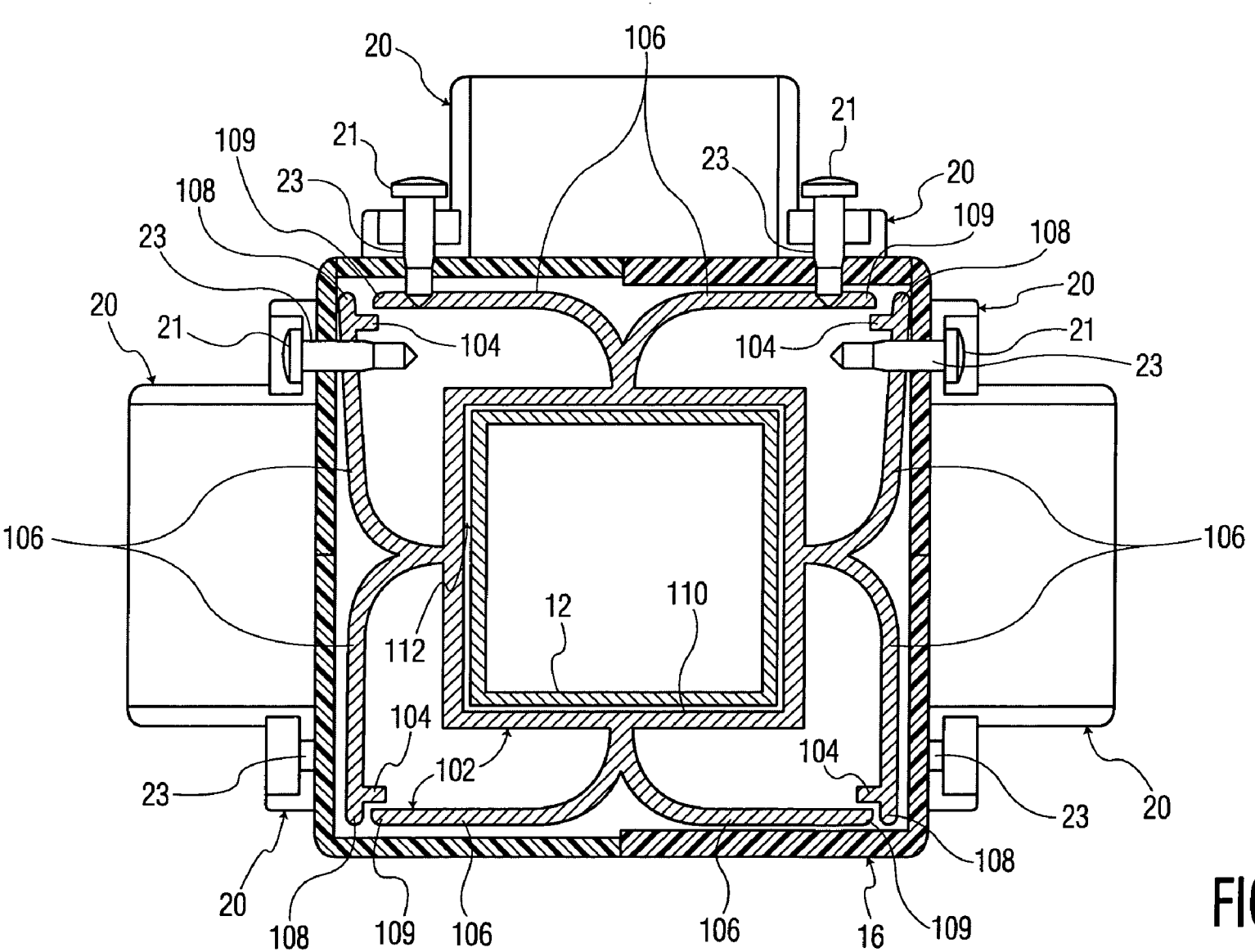
FIG. 8 is a top cross-sectional view of a post mount guide installed in the fence assembly for another embodiment of the present invention.

Referring to FIG. 8, a post mount guide 102 is shown installed on a post mount 12 within the decorative cover 16 for another embodiment of the present invention. One or more top railing brackets 20 each are positioned exterior to the cover 16 for attachment to mounting panels 106 of the post mount guide 102. The fastener holes 23 permit the screw fasteners 21 to be inserted therethrough. The post mount guide 102 is similar to the previous embodiment of the post mount guide 10. However, in the present embodiment, the post mount guide 102 is constructed as a single, unitary component. The post mount guide 102 includes a center portion 110 and a rectangular throughhole 112, and the mounting panels 106 each with a free end portion 108 configured for engagement with the free end portion 109 of adjacent panels 106.

The free end portions 108 of alternating mounting panels 106 each further include a projection 104 configured for blocking the inward bending motion of free end portion 109 of the adjacent mounting panel 106, while permitting outward bending movement thereof away from the center portion 110. Similarly, the free end portions 109 of the mounting panels without the projection 104 are adapted to engage the projections 104 of free end portions 108 of the adjacent mounting panels 106.

Figure 9:
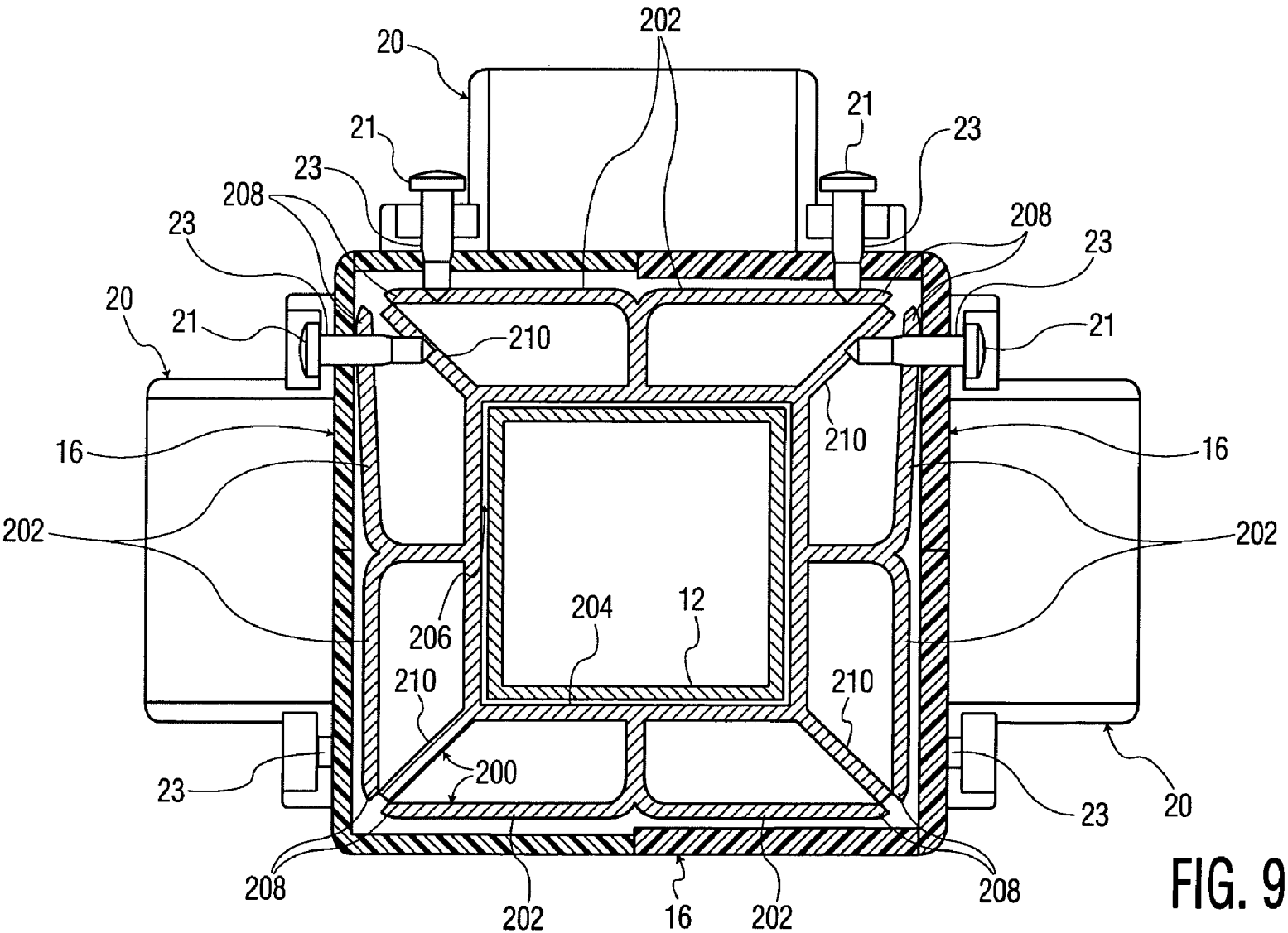
FIG. 9 is a top cross-sectional view of a segment of a post mount guide installed in the fence assembly for a third embodiment of the present invention.

Referring to FIG. 9, a post mount guide 200 is shown installed on a post mount 12 within the decorative cover 16 for another embodiment of the present invention. One or more top railing brackets 20 each are positioned exterior to the cover 16 for attachment to mounting panels 202 of the post mount guide 200. The fastener holes 23 permit the screw fasteners 21 to be inserted therethrough, and into a mounting panel 202. The post mount guide 200 is similar to the previous embodiments. However, in the present embodiment, the post mount guide 200 is constructed as a single, unitary component, and utilizes a different stopping mechanism than prior embodiments.

The post mount guide 200 includes a center portion 204 forming a rectangular throughhole 206, with mounting panels 202 each with a free end portion 208 configured for engagement with a spine 210 extending radially away from the center portion 204, and bisecting the corresponding pair of mounting panels 202 between opposing end portions 208. Each spine 210 is positioned to engage with the free end portions 208 of the corresponding mounting panels 202 for blocking the inward bending motion of the corresponding mounting panel 202, while permitting outward bending movement thereof away from the center portion 204.

Figure 10:
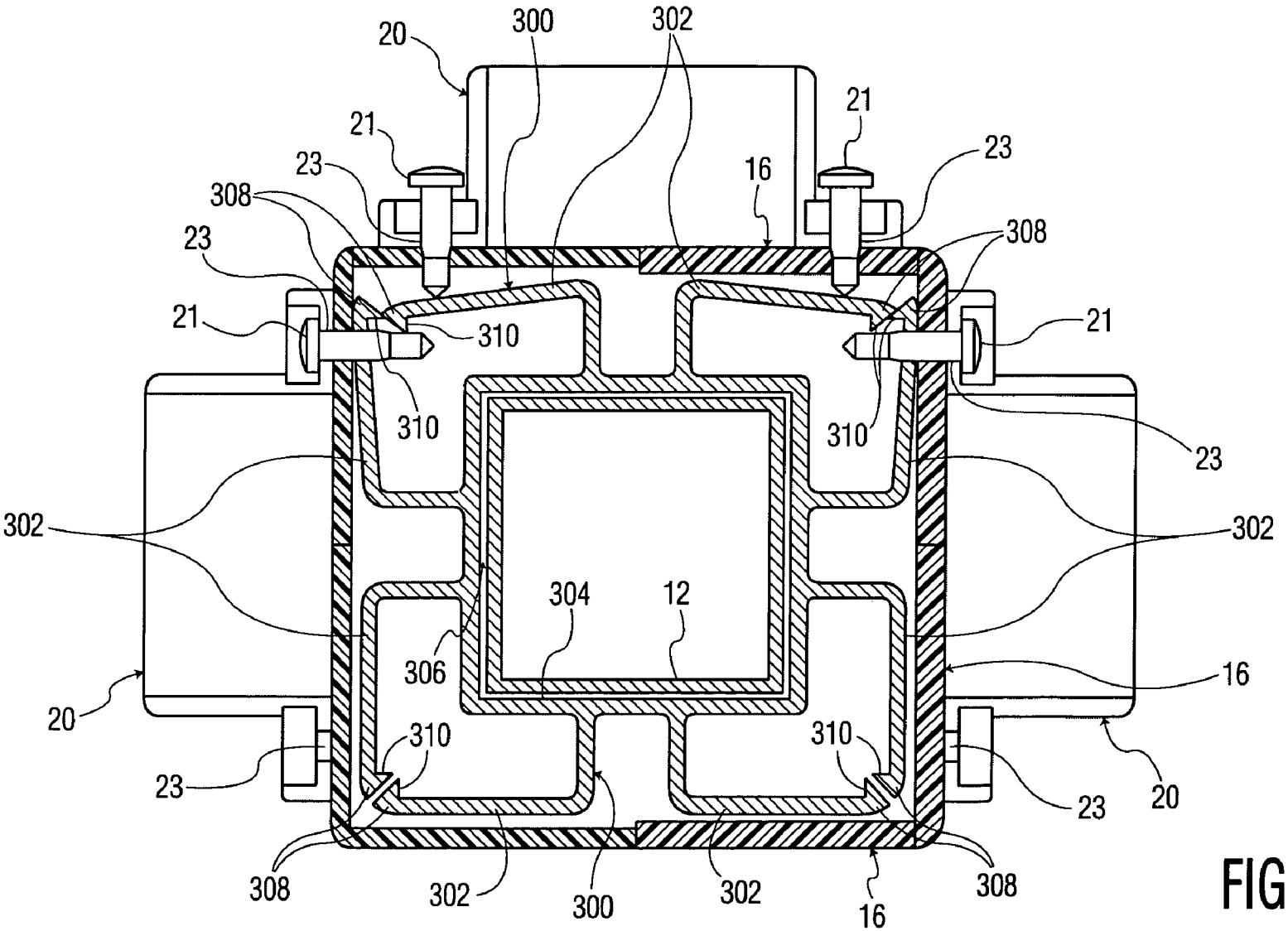
FIG. 10 is a top cross-sectional view of a post mount guide installed in the fence assembly for a fourth embodiment of the present invention.

Referring to FIG. 10, a post mount guide 300 is shown installed on the post mount 12 within the decorative cover 16 for another embodiment of the present invention. One or more top railing brackets 20 each are positioned exterior to the cover 16 for attachment to mounting panels 302 of the post mount guide 300. The fastener holes 23 permit the screw fasteners 21 to be inserted therethrough into an associated mounting panel 302. The post mount guide 300 is similar to the previous embodiments. However, in the present embodiment, the post mount guide 300 is constructed as a single, unitary component, and utilizes a different stopping mechanism than previous embodiments.

The post mount guide 300 includes a center portion 304 forming a rectangular throughhole 306, and mounting panels 302 each with a free end portion 308 configured for engagement with the adjacent free end portion 308. The free end portions 308 of the mounting panels 302 each further include an inwardly directed lip 310 extending therefrom top form flared edges or ridges. The lips 310 of the mounting panels 302 are adapted as stop mechanisms for blocking the inward bending motion of free end portion 308 of an adjacent mounting panel 302, while permitting outward bending movement thereof away from the center portion 304.

The forgoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims. For example, the post mount guide of the present invention can be configured to be circular, or of any other practical configuration, such as octagonal with eight mounting panels, depending upon the associated post mount and decorative cover configuration.

What is claimed is:

1. A post mount guide, comprising:

a tubular body having a throughhole for slidably receiving therethrough an upright support portion of a post mount;

a plurality of pairs of adjacent mounting panels each extending from and spaced apart around outside walls of said tubular body, each mounting panel having one portion connected to the tubular body, and first and second free ends;

said plurality of pairs of adjacent mounting panels and said tubular body being configured to receive and retain a hollow decorative cover, for mounting over the length of the post mount and post mount guide, with said mounting panels being spaced away from inside wall portions of said cover to ensure initial non-intimate contact therewith, whereby when a fastener is inserted through a hole in said hollow decorative cover and secured to a said end of a mounting panel, said free end is adapted to resiliently bend outwardly away from its adjacent mounting panel into intimate contact with an opposing inside wall of said hollow decorative cover upon tightening of said fastener, each mounting panel being configured to receive and retain a fastener therethrough;

the first free end portion of a first adjacent mounting panel including a first distal end and a projection extending inward from an interior surface thereof proximate the first distal end;

the second free end portion of a second adjacent mounting panel including a second distal end adapted to abut the projection of the first distal end of the first adjacent mounting panel to limit inward bending of the second adjacent mounting panel; and the first and second free end portions of said first and second mounting panels, respectively, each being configured to provided for limiting inward movement of the first adjacent mounting panel via its first distal end portion abutting against a portion of the second distal end portion of said second adjacent mounting panel.

2. The post mount guide of claim 1, wherein said plurality of pairs of adjacent mounting panels include two pairs of mounting panels extending radially around the tubular body, and equally spaced apart.

3. The post mount guide of claim 1, further comprising a rectangular profile for receiving a corresponding rectangular hollow decorative cover.

4. The post mount guide of claim 1, wherein the tubular body comprises a rectangular cross section having first through fourth exterior walls.

5. The post mount guide of claim 1, wherein each one of said plurality of pairs of adjacent mounting panels, in combination, comprises an L-shaped cross section.

6. The post mount guide of claim 1, comprising a resilient, durable material selected from the group consisting of plastic polymers, metals and alloys thereof, wood, and combinations thereof.

7. A fence assembly, comprising:

at least one post mount including an upright support portion configured for anchoring to a base;

at least one post mount guide, comprising:

(a) a tubular body having a throughhole for non-frictionally freely slidably mounting upon and receiving therethrough the upright support portion of the post mount;

(b) a plurality of pairs of adjacent mounting panels each extending from and spaced apart around outside walls of said tubular body, each mounting panel having one portion connected to the tubular body, and first and second free ends;

the first free end portion of a first adjacent mounting panel including a first distal end and a projection extending inwardly from an interior surface thereof proximate the first distal end; and the second free end portion of a second adjacent mounting panel including a second distal end adapted to abut the projection of the first distal end of the first adjacent mounting panel to limit inward bending of the corresponding second adjacent mounting panel;

a decorative hollow post cover configured to non-frictionally freely slidably house the upright support portion of the post mount and said at least one post mount guide, with interior walls of said cover being spaced away from said mounting panels;

at least one horizontally oriented rail bracket secured to the decorative hollow post cover via fasteners that screw therethrough into underlying corresponding mounting panels of the respective post mount guide; and wherein the first and second free end portions of said first and second mounting panels, respectively, each being configured to provide for limiting inward movement of the first adjacent mounting panel via its distal end portion abutting against a portion of the second distal end portion of said adjacent mounting panel while permitting the mounting panels to bend outwardly away from said tubular body into intimate contact with an opposing inside wall of the decorative cover when a fastener is tightly secured through said decorative cover into respective ones of said mounting panels.

8. The fence assembly of claim 7, wherein the at least one rail is mounted to the post mount via said rail bracket.

9. The fence assembly of claim 7, wherein said plurality of pairs of adjacent mounting panels include two pairs of mounting panels extending radially around the tubular body, and equally spaced apart.

10. The fence assembly of claim 9, wherein the two pairs of mounting panels are configured to non-frictionally receive and retain the hollow decorative cover, for mounting over the length of the post mount and post mount guide.

11. The fence assembly of claim 10, further comprising a rectangular profile for receiving a corresponding rectangular hollow decorative cover.

12. The fence assembly of claim 7, wherein the tubular body comprises a rectangular cross section having first through fourth exterior walls.

13. The fence assembly of claim 7, wherein each one of said plurality of pairs of adjacent mounting panels, in combination, comprises an L-shaped cross section.

14. The fence assembly of claim 7, comprising a resilient, durable material selected from the group consisting of plastic polymers, metals and alloys thereof, wood, and combinations thereof.

15. A method for using at least one post mount guide for securely and effectively mounting fence components to a post mount, comprising the steps of:

securing a post mount having an upright support portion firmly to a base substrate, the post mount having one end rigidly attached thereto;

positioning the at least one post mount guide at a desired position along the length of the upright support portion of the post mount;

fabricating the at least one post mount guide via the steps of:

(a) forming a tubular body having a throughhole for non-frictionally freely slidably receiving therethrough the upright support portion of the post mount;

(b) forming a plurality of pairs of adjacent mounting panels each extending from and spaced apart around outside walls of said tubular body, each mounting panel having one portion connected to the tubular body, and first and second free ends;

(c) forming the first free end portion of a first adjacent mounting panel including a first distal end and a projection extending inwardly from an interior surface thereof proximate the first distal end; and (d) forming the second free end portion of a second adjacent mounting panel including a second distal end adapted to abut the projection of the first distal end of the first adjacent mounting panel to limit inward bending of the corresponding second adjacent mounting panel;

forming a decorative hollow post cover configured to non-frictionally freely slidably house the upright support portion of the post mount and said at least one post mount guide, with interior walls of said cover being spaced away from said mounting panels;

securing at least one horizontally oriented rail bracket to the decorative hollow post cover via fasteners that screw therethrough into underlying corresponding mounting panels of the respective post mount guide; and configuring the first and second free end portions of said first and second mounting panels, respectively, to provide for limiting inward movement of the first adjacent mounting panel via its distal end portion abutting against a portion of the second distal end portion of said adjacent mounting panel while permitting the mounting panels to bend outwardly away from said tubular body into intimate contact with an opposing inside wall of the decorative cover when a fastener is tightly secured through said decorative cover into respective ones of said mounting panels.

* * * * *